US010682568B2

(12) United States Patent
Hanson

(10) Patent No.: US 10,682,568 B2
(45) Date of Patent: Jun. 16, 2020

(54) GAMING SYSTEM

(71) Applicant: Dion Hanson, Hastings, MN (US)

(72) Inventor: Dion Hanson, Hastings, MN (US)

( * ) Notice: Subject to any disclaimer, the term of this patent is extended or adjusted under 35 U.S.C. 154(b) by 0 days.

(21) Appl. No.: 16/009,708

(22) Filed: Jun. 15, 2018

(65) Prior Publication Data

US 2019/0381393 A1 Dec. 19, 2019

(51) Int. Cl.

*A63F 3/00* (2006.01)
*A63F 7/06* (2006.01)
*A63F 7/30* (2006.01)

(52) U.S. Cl.

CPC ..... *A63F 7/0616* (2013.01); *A63F 7/305* (2013.01); *A63F 2007/3025* (2013.01)

(58) Field of Classification Search

CPC ..... A63F 3/00041; A63F 7/06; A63F 7/0668; A63F 7/30; A63F 2007/3025; A63F 7/305; A63F 7/306; A63F 11/00; A63F 2250/1063

USPC ..... 273/108.1, 108.4, 247, 285, 287

See application file for complete search history.

(56) References Cited

U.S. PATENT DOCUMENTS 174,958 A * 3/1876 Homrighausen ..... A63F 3/0023 273/285
922,717 A * 5/1909 Parker ..... A63B 67/06 273/401
1,145,955 A 7/1915 Wittstein
1,561,421 A * 11/1925 Erickson ..... A63F 3/00031 273/244.1
1,663,404 A 3/1928 Hands
1,701,655 A * 2/1929 Andrews ..... A63F 3/00041 273/247
1,819,932 A * 8/1931 Walden ..... A63F 7/0668 273/108.5
1,992,475 A * 2/1935 De Hart ..... A63F 1/02 273/247
2,060,973 A * 11/1936 Brown, Jr. ..... A63F 3/00041 273/244
2,064,466 A * 12/1936 Downey ..... A63F 3/00041 273/247
2,743,105 A * 4/1956 Westbrook ..... A63F 3/00041 273/247
3,043,594 A 7/1962 Seitz
D204,277 S * 4/1966 Neal ..... 273/285
3,504,787 A * 4/1970 Brockway ..... A61F 17/00 206/38
3,526,403 A 9/1970 Clark
3,628,793 A * 12/1971 Mudloff ..... A63B 67/06 220/324
3,730,528 A * 5/1973 Corrado ..... A63F 3/00041 273/247
3,815,915 A * 6/1974 Chapman ..... A63F 9/0208 273/338
3,869,122 A * 3/1975 Payne, Jr. ..... A63F 7/06 273/247
3,995,863 A * 12/1976 Cummins ..... A63F 3/00041 273/247

(Continued)

*Primary Examiner* — William M Pierce
(74) *Attorney, Agent, or Firm* — Patterson Thuente Pedersen, P.A.

(57) ABSTRACT

The disclosure herein is directed to a gaming system that comprises a game board, a field position indicator, a line of scrimmage stick, projectiles, and a method of play involving these components. The game board can be configured to hinge at a location that is conducive for storage.

8 Claims, 10 Drawing Sheets

(56) References Cited

U.S. PATENT DOCUMENTS 4,003,580 A * 1/1977 Haffey, Jr. ..... A63F 3/00041 273/247
4,009,679 A 3/1977 Kircher
4,082,278 A * 4/1978 Bolton ..... A63F 3/00028 273/247
D248,250 S * 6/1978 Langieri ..... D21/323
4,183,530 A 1/1980 Roop
4,183,531 A * 1/1980 White ..... A63F 7/0608 273/247
4,211,410 A * 7/1980 Smith ..... A63F 3/00041 273/247
4,285,521 A * 8/1981 Joel, III ..... A63F 3/00028 273/247
4,660,836 A * 4/1987 Rhome ..... A63F 3/00041 273/247
4,709,929 A * 12/1987 Mills ..... A63B 63/08 273/402
4,773,650 A * 9/1988 Doughty ..... A63F 3/00041 273/247
4,779,796 A * 10/1988 Lai ..... A63B 69/3652 473/279
4,811,954 A * 3/1989 Hemmann ..... A63F 3/0023 206/315.1
4,872,679 A * 10/1989 Bohaski ..... A63F 7/0668 273/317.5
4,936,590 A * 6/1990 Palmer ..... A63B 63/08 273/285
4,961,586 A * 10/1990 Conville ..... A63B 67/06 273/402
4,982,966 A * 1/1991 Teafatiller ..... A63B 67/06 273/336
4,989,879 A * 2/1991 Nigh ..... A63F 3/00041 273/146
5,040,796 A * 8/1991 Schall ..... A63F 3/00041 116/225
5,054,783 A * 10/1991 Hull ..... A45C 9/00 190/11
D321,910 S 11/1991 Brady
5,087,051 A * 2/1992 LoBue ..... A63F 3/00041 273/247
5,110,127 A * 5/1992 Potter ..... A63F 7/0668 273/108.5
5,145,185 A * 9/1992 Yu ..... A63F 3/0023 206/315.1
5,158,301 A * 10/1992 Martukovich, Jr. ..... A63F 3/00041 273/247
5,186,461 A * 2/1993 Tucker ..... A63F 3/00041 273/247
5,217,229 A * 6/1993 Jaime ..... A63F 3/00041 273/247
5,332,215 A * 7/1994 Gonzales ..... A63F 3/00041 273/239
5,405,141 A * 4/1995 Wilkes ..... A63F 3/00041 273/247
5,451,050 A * 9/1995 Charles ..... A63F 3/00041 273/243
5,496,036 A * 3/1996 Chester ..... A63F 3/00041 273/247
5,501,456 A 3/1996 Collins et al.
5,746,431 A * 5/1998 McIntyre ..... A63F 3/00041 273/247
5,755,441 A * 5/1998 Langan ..... A63F 3/00041 273/247
5,762,338 A * 6/1998 Hutchison ..... A63F 3/00041 273/247
5,769,419 A * 6/1998 Hill ..... A63F 3/00041 273/247
6,227,544 B1 * 5/2001 White ..... A63F 1/00 273/296
6,315,293 B1 * 11/2001 Bush ..... A63F 3/00031 273/244.1
D548,286 S * 8/2007 Taylor ..... D21/303
7,775,525 B2 8/2010 Staver et al.
8,186,683 B2 * 5/2012 Wilheit, Jr. ..... A63B 67/06 273/317
8,196,928 B2 * 6/2012 Thomopoulos ..... A63F 3/00041 273/247
2004/0160002 A1 * 8/2004 England ..... A63F 3/00041 273/247
2004/0195768 A1 * 10/2004 Poulos ..... A63F 3/00028 273/244
2007/0080499 A1 * 4/2007 Greiwe ..... A63B 67/06 273/398
2008/0157476 A1 * 7/2008 Striebel ..... A63B 63/00 273/402
2009/0115136 A1 * 5/2009 Voden ..... A63B 21/0053 273/336
2012/0038108 A1 * 2/2012 McLaughlin, Jr. .... A63B 63/08 273/402
2012/0235356 A1 * 9/2012 Weiss ..... A63F 3/00028 273/398
2013/0032997 A1 * 2/2013 Kolb ..... A63F 3/0052 273/108.4
2015/0258401 A1 * 9/2015 Burkman ..... A63B 67/06 273/409
2016/0220895 A1 * 8/2016 Rosa ..... A63F 7/0616
2017/0173427 A1 * 6/2017 Wolters ..... A63B 67/06
2017/0173428 A1 * 6/2017 Wolters ..... A63B 67/06
2018/0093152 A1 * 4/2018 Florentino ..... A63B 65/00
2018/0178100 A1 * 6/2018 Bunnell-Harvey .... A63B 67/06
2018/0264336 A1 * 9/2018 Florentino ..... A63B 67/06

* cited by examiner

GAMING SYSTEM

TECHNICAL FIELD

The present invention relates to a bean bag football gaming system, and more particularly to a game board to be used in combination with a scoreboard, down indicator, projectiles, and marking sticks and a method of using the same.

BACKGROUND

Games involving bean bags or similar projectile pieces have been a popular and long standing fixture in the lawn games industry. One of the most common bean bag games is cornhole. Traditionally, cornhole involves two boards of identical size with one target opening on each board. The ease of play is typically the draw of such game, but lack of strategy and limitations involved with scoring make for a game that is repetitive and predictable.

With the increasing popularity of bean bag and projectile games, more and more alternatives to the traditional cornhole game have been introduced. Many of these alternatives have focused around football, one of the most popular American sports of our time. For years cornhole has been a fixture at football tailgating events, and more recently as the interest in cornhole has surged, many cornhole games have been introduced that incorporate the rules of football into the game itself.

One such game is a traditional cornhole board with multiple target openings and alternative game play styles as described in U.S. Pat. No. 7,775,525 to Stayer et al. ("Stayer"), which is herein incorporated by reference. Stayer discloses a manual game which simulates American football with points earned or lost by hitting a target opening that represents outcomes or advancements as seen in a real football game. Such target openings include "−10 yd. sack", "fumble", "+35 yd. deep out" etc. However, because points are only earned by successfully passing a projectile through a target opening, there is no way to gain or score points if a projectile lands on the board itself and not through an opening. Further, there are no rules indicating starting positions for tossing the projectiles. Therefore, essentially all players, regardless of age or height, start as equals.

More recent games have attempted to include additional football rules and point scoring opportunities by adding target openings for a "hail mary," "turnover," or "−5 yd. foul." Such a game is disclosed in U.S. patent application Ser. No. 15/380,109 to Wolters ("Wolters"). Similar to Stayer, the game board in Wolters includes multiple target openings that correspond to a play losing or gaining points. Wolters discloses a bean bag tossing game incorporating kickoffs, punts, and gains and losses of yardage. However, like Stayer, there is not opportunity to gain or lose points unless a projectile successfully passes through an opening.

An alternative to a game incorporating target openings is a game described in U.S. Pat. No. 4,183,530 to Roop ("Roop"). Roop discloses a football game apparatus comprising a game board having thereon a visual representation of a football field including spaced lines representing 10 yard intervals. The game consists of a cork board and projectiles, such as darts, used in game play and, unlike Wolters and Stayer, there are no target openings. Instead, the game board in Roop is divided to represent scoring opportunities for players, with the field goal being a two and one-half inch by two inch section, not goal posts as typically used in real football or the football cornhole games disclosed by Stayer.

The games previously disclosed all incorporate the traditional rules of football in a lawn game type format. However, one of the major pieces of football is scoring. Scoring involves first through forth downs, gains and losses of yardages for catches, interceptions or penalties. Additionally there are scoring opportunities with touchdowns, field goals, touchback, and two-point conversions. Representing accurate movement of the football on the field according to the rules of football can present a challenge. Ability to easily track each "team" or "player" movement can present a challenge when incorporating the nuances of the game to a lawn game such as cornhole.

One such proposed solution is disclosed in a display for a simulated football game in U.S. Pat. No. 4,009,679 to Kircher ("Kircher"). Kircher discloses a display including an elongated main panel having indicators arranged to mark yards and clips that are alignable with selected yard indicators. The scoring mechanism disclosed in Kircher is to be used with a dart game similar to that of Roop, but with far less complexity and rules for game play. Therefore the scoring mechanism itself does not include or account for all possibilities of football, such as punting.

SUMMARY

The present invention is directed to a kit and method of play for a game comprising projectiles and a simulated football field. More specifically, the invention is directed to a kit comprising a game board that can be folded up to store all pieces of the game, instructions for use, a scoreboard with a ball and down indicator, bean bags, and marking sticks for different players. The invention is also directed to a method of play comprising the kit as and rules that are adapted from American football.

According to embodiments, game play closely resembles the scoring and rules of traditional American football. The game comprises the use of beanbags and a game board with graduated spaced field markers resembling a football field. According to an embodiment, the board can have an inclined surface with uniformly spaced yardage lines. The yardage lines include distance indications the resemble distance indications as seen on a real football field. According to an additional embodiment, the game board can also comprise yardage lines that are unevenly spaced to simulate difficulty of play. The smaller the distance between yardage lines, the more yardage earned. In some embodiments the board can also comprise defined spaces that correspond with yardage losses or penalties to make game play more difficult.

According to the method of play, each player uses a marking stick to position him- or herself at an appropriate distance from the board; this distance remains that player's tossing position for the duration of the game. Each player has four beanbags, three of one color and one of a different color. In a preferred embodiment a player has three brown projectiles and one red projectile. According to one embodiment for a method of play, after each player is in position, a coin is flipped to determine who begins the game. The winning player chooses whether he or she would like to "kick off" or "receive." The player who chooses to kick off "punts," or tosses, a bag on to the board to determine the starting yardage for the receiving player. This yardage is marked on a scoring stick and the game begins.

The player who chooses to the "punt" begins by tossing one brown bag at a time on to the board. With each toss, points or yards are gained or lost and the score indicator is moved accordingly to indicate the loss or gain for each toss. The first down indicator on the scoring stick is moved each time a player achieves a gain of ten yards or more. Game play continues in this manner until a player scores a touchdown or a player is unable to score after a forth down.

According to embodiments, the game board can additionally be configured to fold in half, providing a space to store all the pieces of the game. The scoring piece and measuring stick are configured to fold into smaller segments, allowing for easy storage within the game board. The projectile pieces are also sized for convenience of storage in the game board. After all pieces have been placed in the game board, the board folds in half and locks to prevent accidental opening during transport. In some embodiments the game board can also comprise a carrying handle for easier totability.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1A:
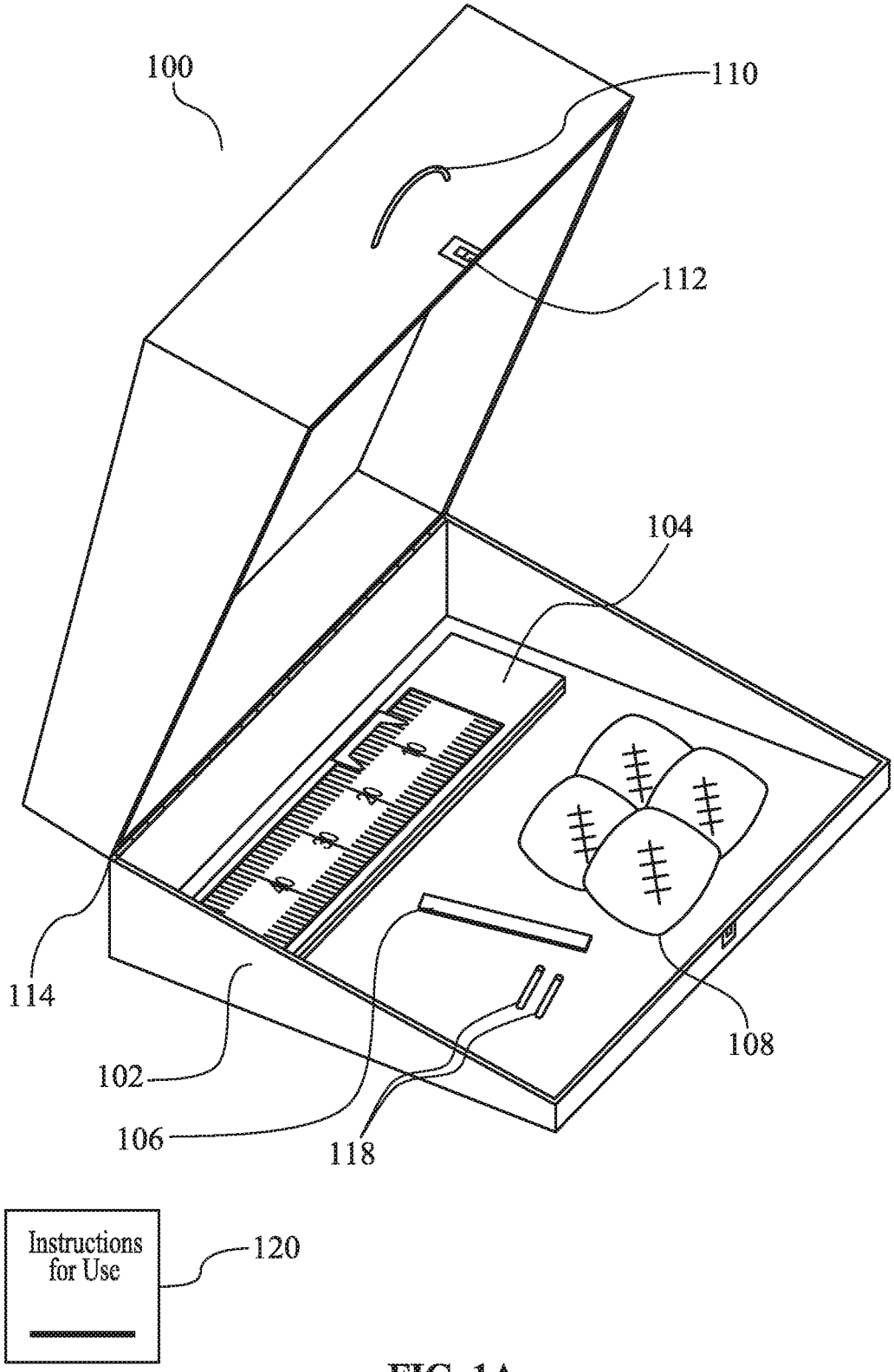
FIG. 1A is a perspective view of a gaming system kit according to an embodiment.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

The lawn games previously described in the Background all attempt to incorporate the rules of football into a type of lawn game; however, none of the games include the ability to account for all aspects of the game such as punting or two-point conversions. More specifically, there remains a need for a game that can incorporate a point system for a game in which a projectile is not completely in a target point area. Assigning points to a projectile that is on a line, over a target point area, or off the board incorporates scoring that is more realistic to the game of football itself. Such a scoring system should also accurately account for all gains and losses of yardage, including punts.

There also remains a need for a system that accounts for variances amongst players of the game. Because cornhole games are dependent on a player's ability to successfully throw a projectile onto the board, there are many variances that can impact a successful toss. Often, players of a game are different heights and ages, and these factors can impact the ability of a player to successfully toss a projectile onto a game board. Therefore, a system for positioning players at an initial tossing line is also desirable for creating a game where all players are positioned fairly.

Furthermore, there remains a need for a game that is easily transportable. Current cornhole games, and those as described in Stayer, Wolters, and Roop, consist of large and bulky game boards that are hard to store, tote around or travel with. Further, these games lack the ability to store projectiles and/or additional game pieces, often leading to game pieces being lost. Therefore there still remains a need for a game that comprises a comprehensive scoring system and ability to account for player variances, while also having the ability to be compacted for easy storage and totability.

According to embodiments a gaming system comprises a game board, a field position indicator, a line of scrimmage stick, projectiles, and a method of play involving these components. Components can be configured to hinge at a location that is conducive for compaction and storage.

According to embodiments, the method of play consists of two halves, each half made up of two fifteen minute quarters and incorporates two or more users and rules and point scoring that resembles that of traditional American football. To begin play, each player picks and end zone corresponding to each of the users and one player flips a coin to determine the receiver and punter for the initial kick off. To kickoff, the first player throws the projectile from his or her tossing line. The starting position of the receiver is determined by the landing position of the most distal portion of the projectile thrown by the punter. For example, a projectile that crosses a yardage line is allotted points according to the landing position of the most distal portion the projectile touches. The initial starting position for the receiver is then marked on the game positioning board and the receiver takes control of all four projectiles.

The second player then tosses the first projectile. The score is determined by the landing position of the first projectile and points are allotted accordingly. Points scored, yardage achieved, and ball location are all marked on the ball positioning board and the projectile is then removed from the board. This process is repeated for the next two projectiles. With the last projectile, the user must call out his or her intention for play, wherein the options consist of kicking a field goal, going for a fourth down, or punting the projectile. Points are only awarded if the user achieves his or her stated intention of throwing the projectile. The steps of tossing a projectile assigning yardage and scoring points is repeated until a user was unsuccessful in scoring a first down, the user was unsuccessful in completing the stated intention of the fourth projectile, or a touchdown was scored. These steps are repeated for the first half of the game. At the beginning of the second half, the opposite user kicks off and receives. The steps for scoring and tossing are repeated according to the first half and the winner is determined by the user with the highest total points at the end of the four fifteen minute quarters.

According to an embodiment of the invention as depicted in FIG. 1A, a gaming system kit 100 can comprise game board 102, field position board 104, line of scrimmage stick 106, projectiles 108, goal posts 118, an optional timer (not pictured), and instructions for use 120. When game board 102 is not in game use, game board 102 can be folded in half at hinge 114 for secure storage and transportation of the game board and pieces previously disclosed. According to embodiments for this particular use, game board 102 is laid flat on its game surface so that the underside of game board 102 is facing upward. At this point, the previously disclosed game pieces (including instructions 120) can be placed on the underside of game board 102. When all desired pieces of the game have been positioned on the underside of game board 102, the game board 102 can be hinged at hinge 114 and game board 102 can be completely shut. To aid in ease and security of storage, game board 102 can also comprise closure mechanism 112 and handle 110.

Figure 1B:
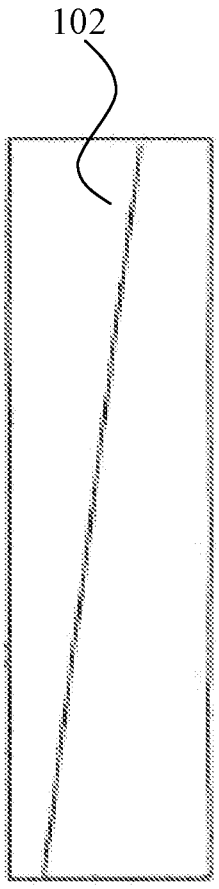
FIG. 1B is a side view of the game board when completely hinged closed according to an embodiment.
Figure 1C:
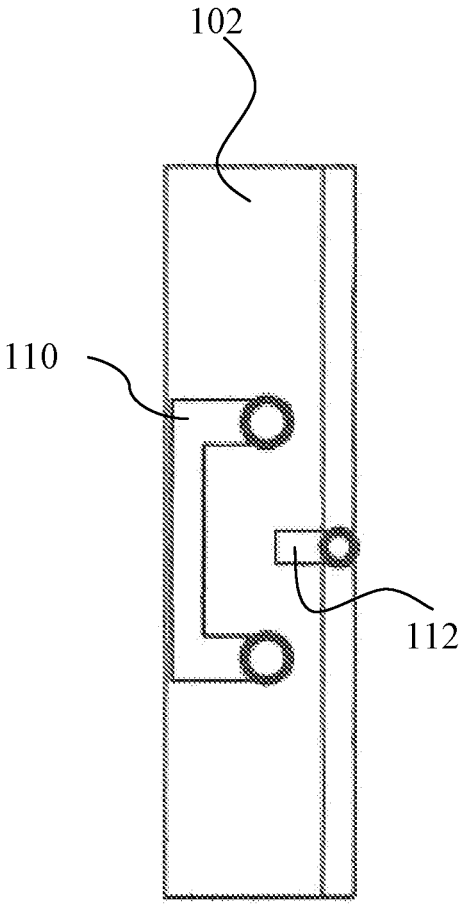
FIG. 1C is a top down view of a game board when completely hinged closed according to an embodiment.

As depicted in FIG. 1B, when game board 102 is completely hinged shut it is a smaller rectangular shape. This shape allows for easier transportation and storage. As seen in FIG. 1C, handle 110 and closure mechanism 112 provide for increased ease of carrying and security of the components during transportation and storage.

Figure 2A:
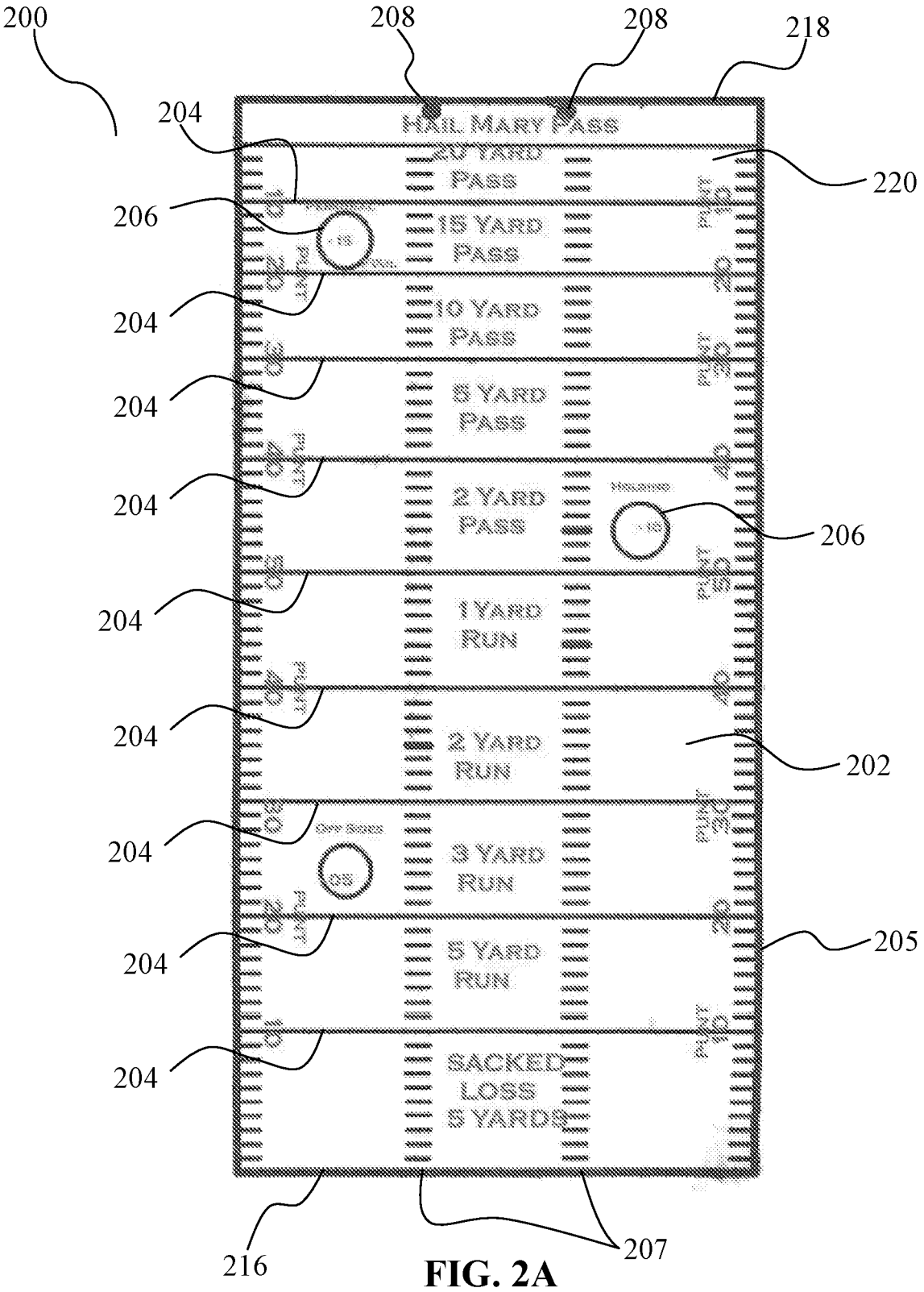
FIG. 2A is a plan view of a playing surface of a game according to an embodiment.
Figure 2B:
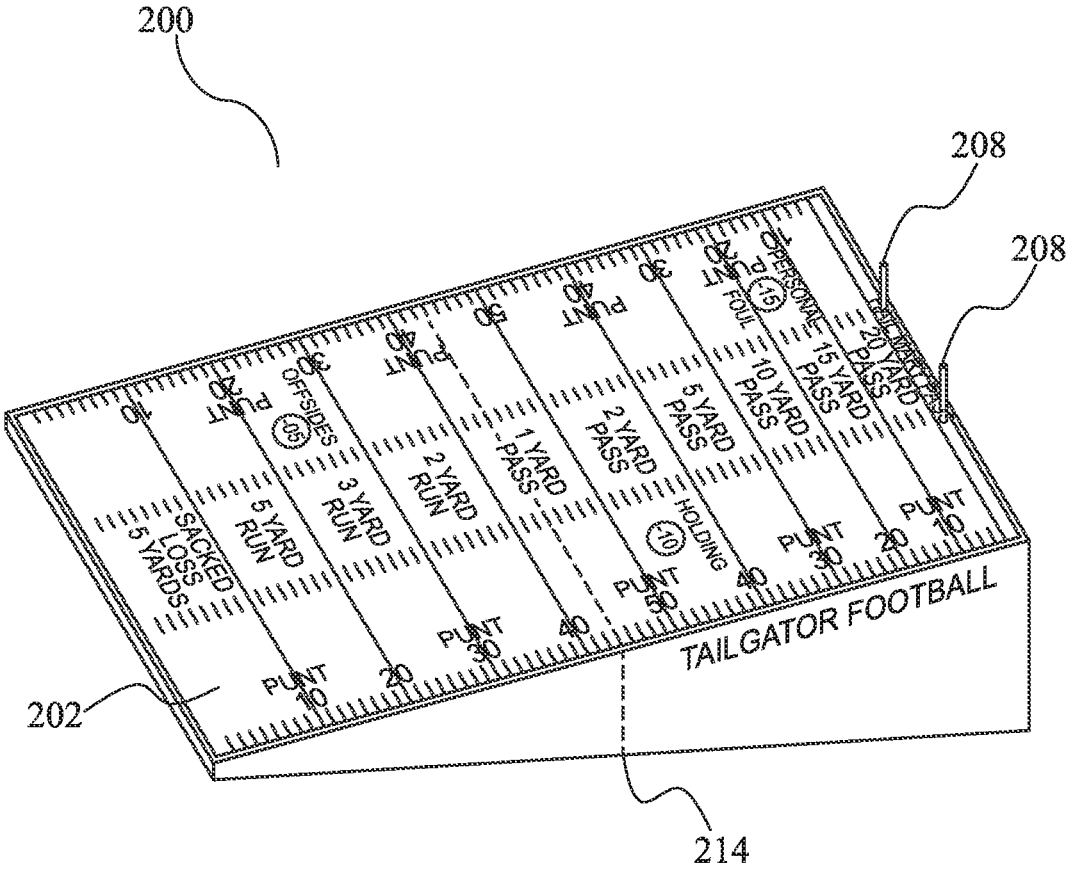
FIG. 2B is perspective view of a game board according to an embodiment.
Figure 2C:
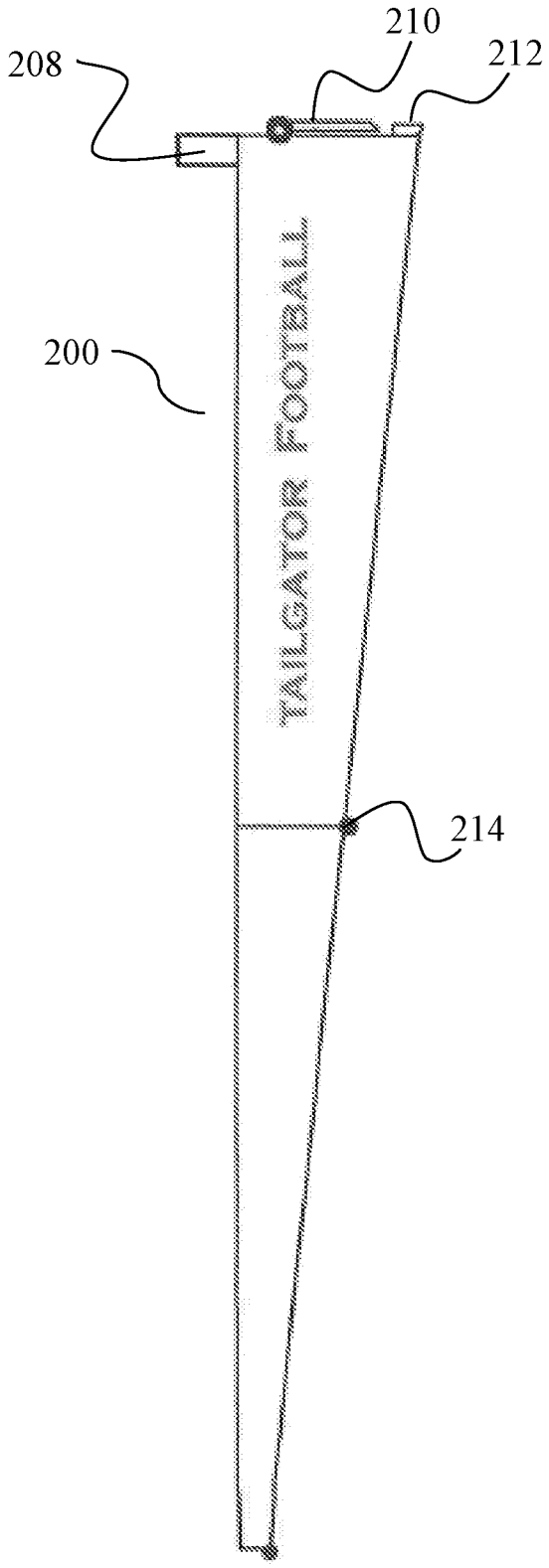
FIG. 2C is a side view of a game board according to an embodiment.
Figure 2D:
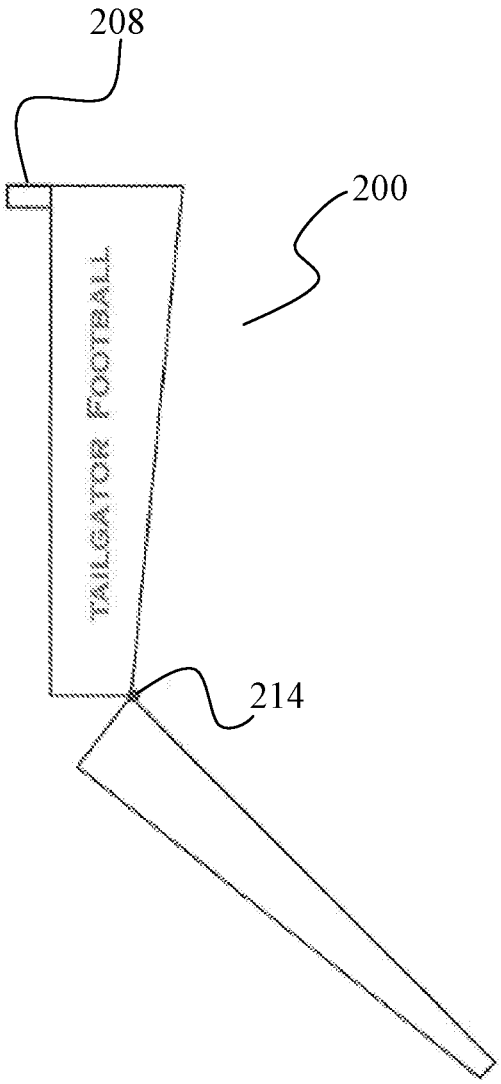
FIG. 2D is a side view of a game board in a partially closed position according to an embodiment.
Figure 2E:
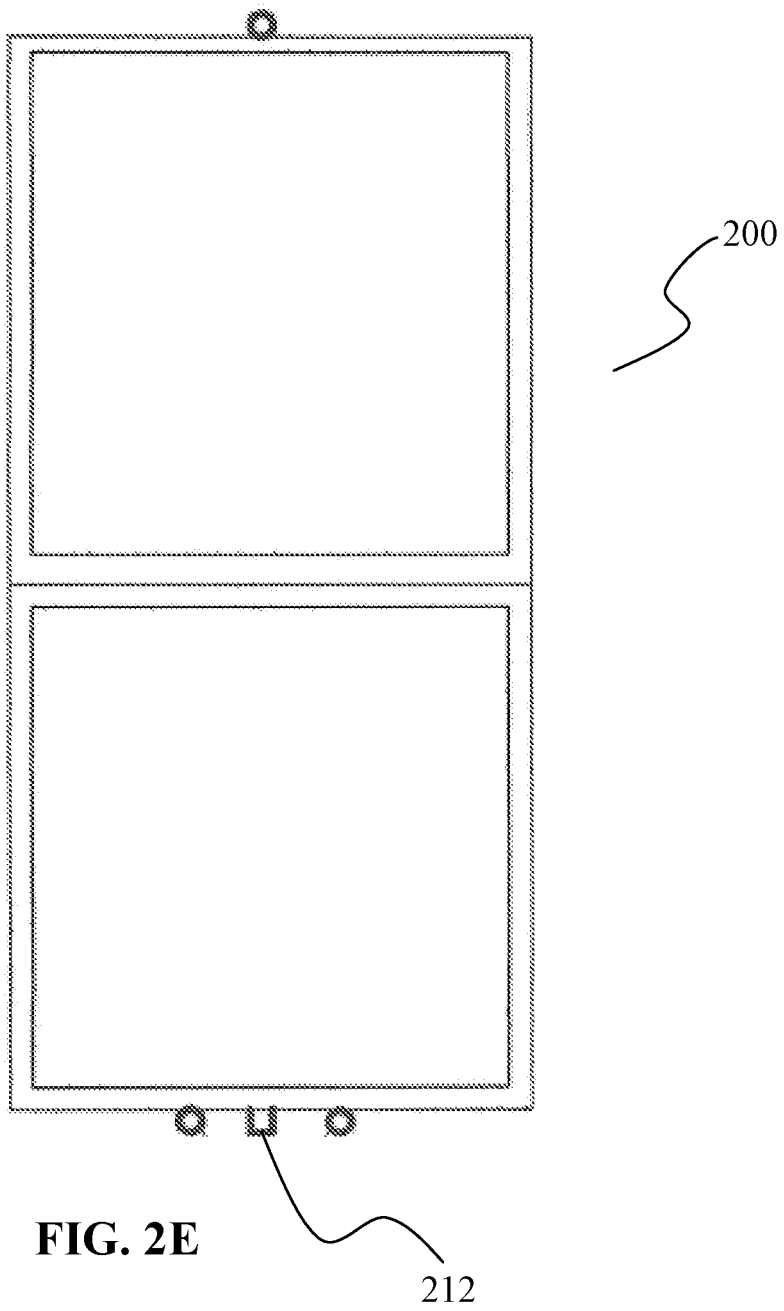
FIG. 2E is a bottom view of a game board according to an embodiment.

According to embodiments, the game broadly comprises a hollow, generally wedge-shaped body as depicted in FIGS. 2A-2D. According to embodiments a game board 200 can include game surface 202. Game surface 202 can have a plurality of yard lines 204, circular areas 206 that represent penalties, removable upright goal posts 208, punt indicator lines 205, and middle field dashed lines 207. As depicted in FIG. 2C, when viewed from the side, game board 200 also comprises carrying handle 210 and closure mechanism 212.

Game board 200 as depicted in FIGS. 2A-2D is intended to represent an American football field. Accordingly in a preferred embodiment, surface 202 of game board 200 comprises indicia representative of traditional American football field markings. Indicia representative of American football includes yard lines 204, punt lines 205, and dashed middle field lines 207. According to an embodiment, surface 202 is green, yard lines 204, punt lines 205 and dashed lines 207 are white, and goal posts 208 are yellow. In a preferred embodiment, game board 200 is 1' 11" wide and 3/11" long when open for play. According to embodiments, game board 200 has a top surface 202 which slopes downward as a result of the wedge-shape. According to a preferred embodiment, board 200 is 5½" tall at one end and tapers to 1" at an opposite end to create the wedge shape as depicted in FIGS. 2A-2D. In alternative embodiments, the indicia on the surface of board 202 could be replaced with indicia corresponding to other games rather than football, or could correspond to a new type of game altogether rather than relating to the events that occur in any known game.

Game board 200 can also include hinge 214. Hinge 214 is located centrally between the two game board ends. In one embodiment hinge 214 is preferably located 1' 11½" from each end of game board 200. Game board 200 can be hinged shut at hinge 214. In this embodiment game board 200 measures 1' 11" by 1' 11½" when hinged closed.

According to an embodiment, game surface 202 comprises two ends, proximal end 216 and distal end 218, and a series of yard lines 204. According to this embodiment, the spaces between yard lines 204 assign point values to common American football plays such as "runs" or "passes."

According to preferred embodiments, the spacing between yard lines 204 decreases from proximal end 216 to distal end 218. For example, according to a preferred embodiment, the space between proximal end 216 and first yard line 204 represents "sacked loss 5 yards" and is 6¼" wide. According to this embodiment the first yard line 204 represents a 10 yard punt. The second space on game surface 202 represents a "5 yard run." The distance between the first yard line 204 and second yard line 204 is 5" and the second yard line 204 represents a 20 yard punt. The third space on game surface 202 represents a "3 yard run." The distance between second yard line 204 and third yard line 204 is 5" wide and the third yard line 204 represents a 30 yard punt. The forth space on game surface 202 represents a "2 yard run." The distance between the third yard line 204 and forth yard line 204 is 5" wide and the forth yard line 204 represents a 40 yard punt. The fifth space on game surface 202 represents a "1 yard run." The distance between forth yard line 204 and fifth yard line 204 is 5" and the fifth yard line 204 represents a 50 yard punt. The sixth space on game surface 202 represents a "2 yard pass." The distance between fifth yard line 204 and sixth yard line 204 is 5" and sixth yard line 204 represents a 40 yard punt. The seventh space on game surface 202 represents a "5 yard pass." The distance between sixth yard line 204 and seventh yard line 204 is 4⅜" and the seventh yard line 204 represents a 30 yard punt. The eighth space on game surface 202 represents a "10 yard pass." The distance between seventh yard line 204 and eighth yard line 204 is 3¾" and eighth yard line 204 represents a 20 yard punt. The ninth space on game surface 202 represents a "15 yard pass." The distance between eighth yard line 204 and ninth yard line 204 is 3⅛" and the ninth yard line 204 represents a 10 yard punt. The tenth space on game surface 202 represents a "20 yard pass." The distance between ninth yard line 204 and tenth yard line 204 is 2½". The eleventh space on game surface 202 represents a "Hail Mary Pass." The distance between the tenth yard line 204 and distal end of the board 218 is 1⅛".

According to embodiments, game surface 202 also can comprise goal posts 208. Goal posts 208 are positioned 7¼" inches from each side of game board 200 and are 7½" from each other. According to an additional embodiment, game surface 202 can also comprise additional football marking indicia such as punt lines 205 and center field dashes 207. In one embodiment, the lines boarding the edge of game board 200 are punt lines 207. In a preferred embodiment, punt lines 207 are ⅜" wide. In an alternative embodiment, game surface 202 can also comprise center field dashes 207. Center field dashes are 3/16" wide. In a preferred embodiment, game surface 202 comprises two vertical rows of center field dashes 207. According to this embodiment, both first vertical rows begin at proximal end 216 and run length wise to distal end 218. The first row is positioned 7¼" from the left edge of game board 200 and the second row is positioned 7¼" from the right edge of game board 200. The distance between the two center field dashes 207 is preferably 7½".

Game surface 202 can also comprise spaces that correspond to penalties. In a preferred embodiment, game surface 202 has three penalty areas. In alternative embodiment more than three penalty areas are contemplated. In a yet alternative embodiment less than three penalty areas are contemplated. In the preferred embodiment, penalty areas 206 are circular and are spaced on game surface 202 to increase difficulty of play. For example, in a preferred embodiment, one penalty area 206 is located on the left side of game surface 202 in the "3 yard run" space. This penalty area represents "off sides" and corresponds with a loss of 5 points. A second penalty area 206 is located on game surface 202 on the right side of the board in the "2 yard pass" space. This penalty area represents "holding" and corresponds with a loss of 10 points. A third penalty area 206 is located on the left side of game surface 202 in the "15 yard pass" space. This penalty represents a "personal foul" and corresponds to a loss of 15 points.

Figures 3A, 3B, 3C:
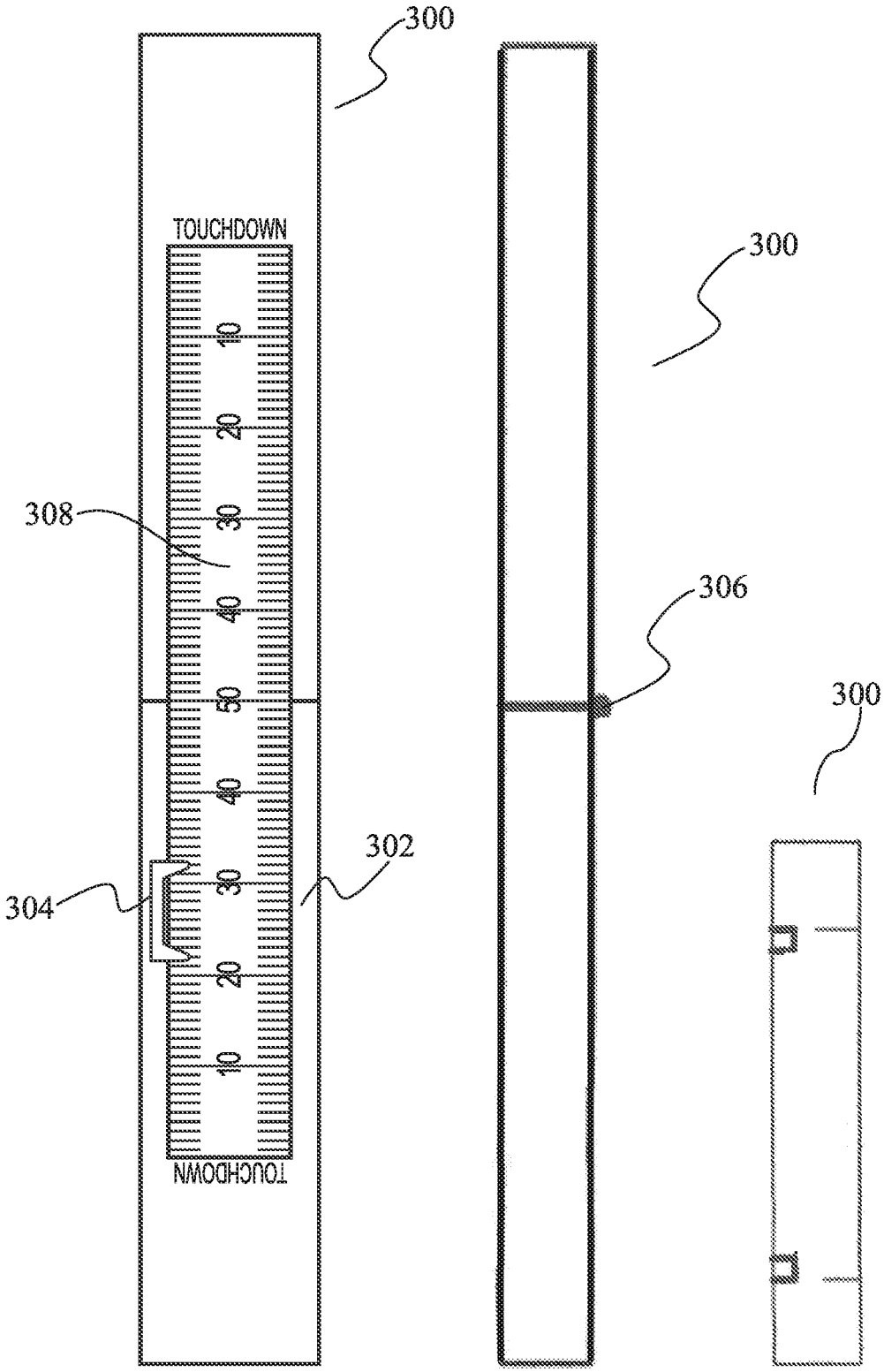
FIG. 3A is a plan view of a game position board according to an embodiment.
FIG. 3B is a side view of a game position board according to an embodiment.
FIG. 3C is an end view of a game position board according to an embodiment.

According to embodiments and as depicted in FIGS. 3A-3C, the game can also comprise one or more game positioning board 300. Game positioning board 300 can comprise sliding ball indicator 302, first down indicator 304, and center field detail 308. Game positioning board 300 can also comprise hinge 306 to allow game positioning board 300 to fold for storage and/or travel. In preferred embodiments, game positioning board 300 is green and all marking lines are white.

The disclosed embodiment of game positioning board 300 is preferably 3' by 7" and ¾" high. Center field indicator 308 is preferably a 30" by 4" area and is a centered print on the game positioning board 300. Lines and hash marks are used to accurately represent game surface 202 on center field indicator 308. According to embodiments, the perimeter of center field indicator 308 is preferably ⅜" thick. Yard lines running horizontally from the perimeter lines of center field indicator are ¼" thick, and hash marks around the perimeter are preferably ⅛" thick. According to embodiments, game positioning board 300 also can comprise a hinge 314 preferably located 18" from each end of the board.

Figures 4A, 4B, 4C:
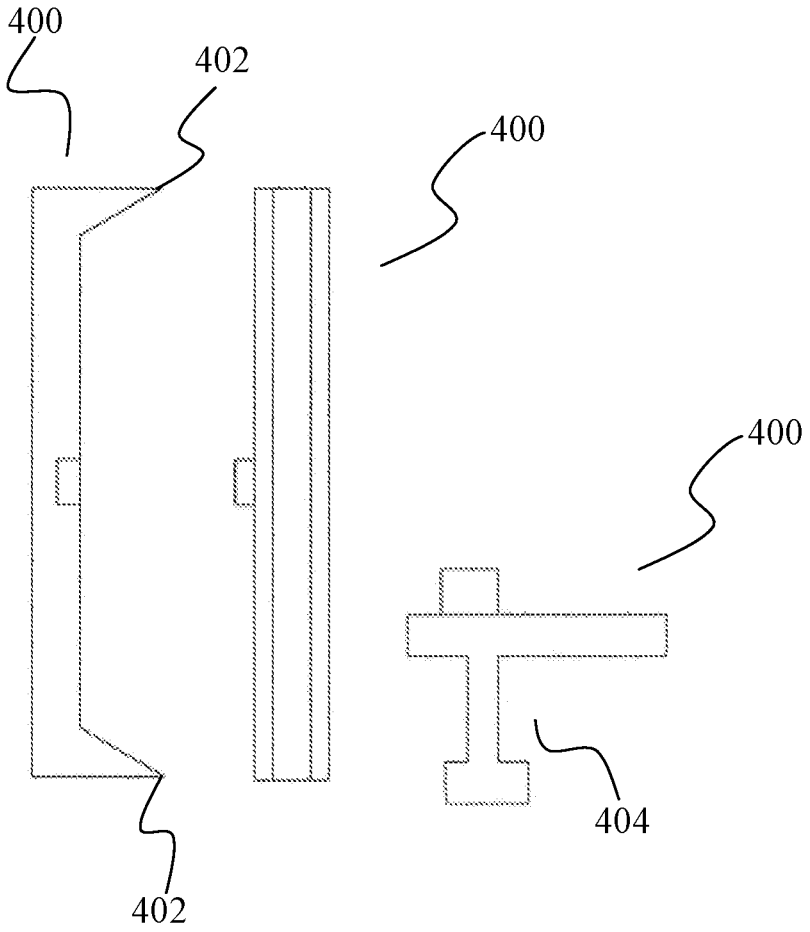
FIG. 4A is a plan view of a first down indicator according to an embodiment.
FIG. 4B is a side view of a first down indicator according to an embodiment.
FIG. 4C is a sectional view of a first down indicator according to an embodiment.

FIGS. 4A-4C depict a first down indicator 400 according to embodiments. First down indicator 400 can be used as part of a scoring system (e.g., first down indicator 304 as described above with respect to FIGS. 3A-3C). First down indicator 400 can comprise two pointed ends 402 that allow for precise marking of game positions. Indicator 400 can also comprise a notch 404 as depicted in FIG. 4C. Notch 404 allows indicator 400 to attach and slide along the edge of game positioning board 300. According to a preferred embodiment, first down indicator 400 is red in color. According to one embodiment, first down indicator 400 is made from extruded plastic. In an alternative embodiment, first down indicator 400 is made from metal. In a yet even alternative embodiment, first down indicator 400 is made from any material not disclosed herein.

The disclosed embodiment of first down indicator 400 is preferably 3" long and 1" wide. As depicted in FIGS. 4A and 4B, first down indicator 400 also comprises ¼" rectangular section 410 located 1 1/16" from the ends of indicator 400. In embodiments indicator 400 is ⅝" high, which comprises ⅛" tall rectangular section 410 coupled to indicator 400. When viewing a cross section of indicator 400 as depicted in FIG. 4C, notch 404 is positioned 9/16" from the right edge of indicator 400. Notch 404 is used to position indicator 400 on positioning board 300 and allows for sliding of indicator 400 along the edge of positioning board 300.

Figure 5A:
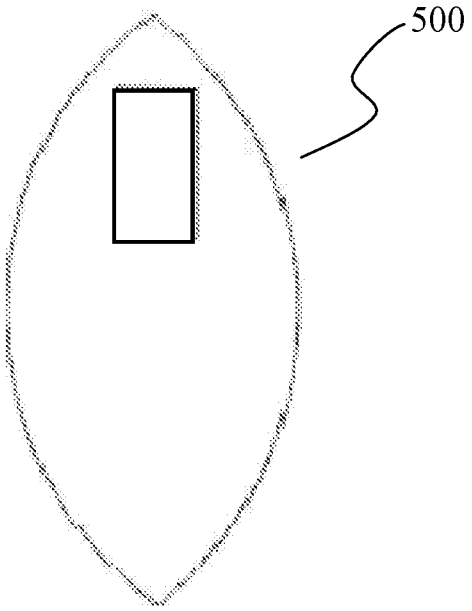
FIG. 5A is a plan view of a sliding ball indicator game piece according to an embodiment.
Figure 5C:
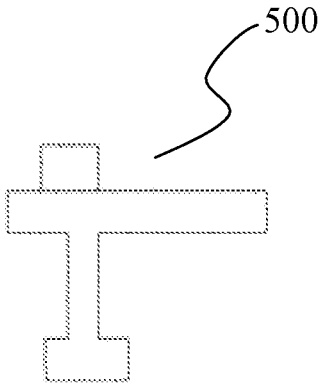
FIG. 5C is a sectional view of a sliding game ball indicator according to an embodiment.
Figure 5B:
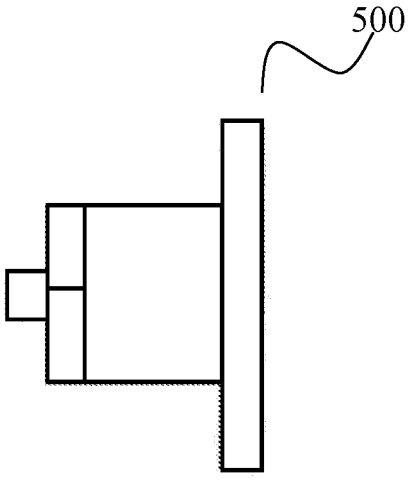
FIG. 5B is a side view of a sliding game ball indicator according to an embodiment.

The game positioning board 300 can also comprise sliding ball indicator 500. As depicted in FIGS. 5A and 5B, sliding ball indicator 500 resembles an American football and can attach to positioning board 300 in a manner that allows for ease of movement along the edge of game board 300. In a preferred embodiment, sliding ball indicator is brown in color and made from extruded plastic. In an alternative embodiment, sliding ball indicator 500 is made from metal. In a yet even alternative embodiment, sliding ball indicator 500 is made from any material suitable for human use. The disclosed embodiment of sliding ball indicator 500 is preferably 1" long by ½" wide at the indicator's widest section and ⅝" high. As shown in FIG. 5C, sliding ball indicator 500 can also include a notch for sliding along a board as described above with respect to notch 404 of FIG. 4C.

Figure 6:
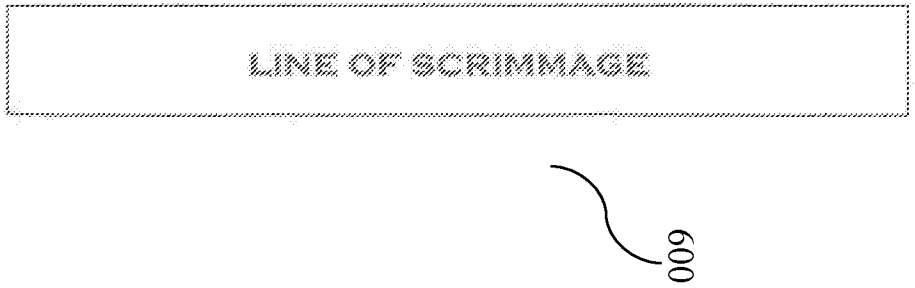
FIG. 6 is a plan view of a line of scrimmage stick according to an embodiment.

As depicted in FIG. 6, the game also comprises at least one line of scrimmage stick 600, and often will include a plurality of line of scrimmage sticks. According to a preferred embodiment, line of scrimmage stick 600 is 12" in length, 1½" wide and ¼" thick. In one embodiment line of scrimmage stick 600 can be made from plastic. In an alternative embodiment, line of scrimmage stick 600 can be made from wood. In a yet alternative embodiment, line of scrimmage stick 600 can be made from any material not disclosed herein.

Figure 7:
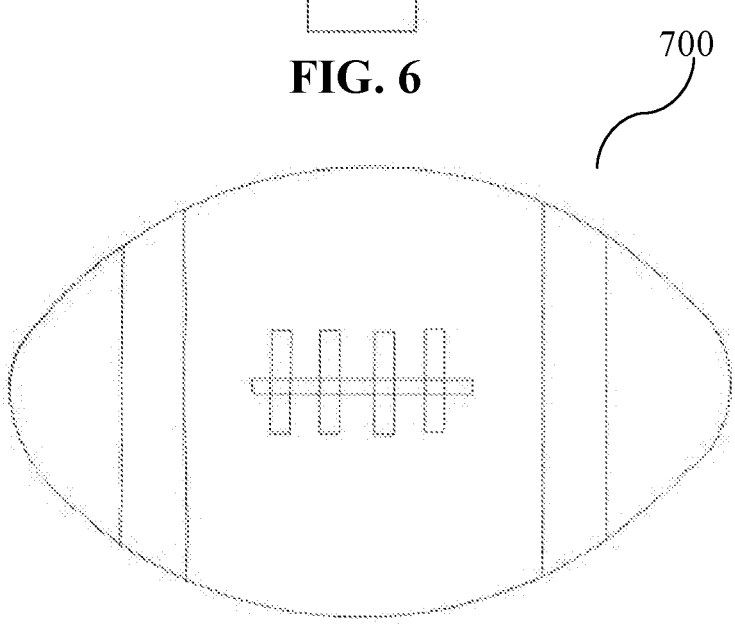
FIG. 7 is a plan view of a projectile game piece according to an embodiment.

As depicted in FIG. 7, the game also comprises projectiles 700. According to a preferred embodiment, projectile 700 resembles an American football. In alternative embodiments projectile 700 can have a square profile, a round profile, or other dimensions that are compatible with tossing. The disclosed embodiment of projectile 700 is preferably 5½" long by 4" wide at its widest section. In a preferred embodiment projectile 700 can be a beanbag type projectile made from canvas and filled with plastic pellets. In an alternative embodiment, projectile 700 can be made from plastic. According to alternative embodiments, projectiles 700 can be made of other materials.

In use the game pieces as described herein are used to play a game that emulates American Football but in a novel context, such as on a lawn or at a tailgating event, wherein distinct actions are transposed into events that may occur during an American Football game. To begin the game, as depicted in FIG. 1, game system 100 is opened and pieces are removed. Game board 102 is opened and laid out as shown in FIG. 2B, with game surface 202 facing in a generally upwards direction with respect to a gravitational reference frame. Field position indicator 300 as depicted in FIG. 3A is unhinged to full extension and laid on a flat surface close, but not in an obstructive path, to game board 200. Field goal posts 118 are positioned on game board 200 in game board holes that are in the game board.

Multiple different approaches are contemplated that can be used to measure appropriate toss distance. In a first embodiment, a player places one foot at the base of game board 200 so that the foot heel is directly against the proximal end 216 of game board 200. The player then takes five long strides away from the game board 200 and on the last stride line of scrimmage stick 600 is placed to create a marked spot—this is the tossing line for that player. This process of marking a starting position is repeated for each player. In such embodiments, each player has a unique scrimmage stick 600. In such embodiments, scrimmage stick 600 can be customized, for example with different colors, shapes, or sizes corresponding to each player. In a second embodiment, all players can throw from the same line. In various alternative embodiments, different numbers of steps can be taken, or the winner of a previous round can be required to take an extra step from the board 200, for example.

The game itself is broken into four 15 minute quarters, two 30 minutes halves. Projectile position on the field is important. Where the projectile lands on game surface 202 determines how that toss is scored. The lines on game surface 202 determine field position for each toss. The projectile touching the most distal line or positioned over the most distal line is scored according to the marking on the space more distal to the landed projectile. For example, if a projectile lands on a yard line that separates a "3 yard run" and a "2 yard run" the projectile is scored as a 2 yard run. Alternatively, is a projectile is touching a yardage line separating a "15 yard pass" and a "personal foul" penalty, the projectile is scored as a personal foul penalty and the player loses 15 yards. A projectile that is partially off game board 200 is still in play as long as more than half the projectile is on the board. Points are determined as follows—a touchdown is 6 points; extra point is 1 point; field goal is 3 points; and touch back is 2 points. The game concludes after all 15 minutes quarters have been played. The winner is the player with the highest score at the end of the game.

One possible method of use of these systems is described below. Play begins with a randomizing event such as a coin toss, the winner of which can decide whether he wishes to be the kicker or receiver. The kicker takes his or her position at the toss line and a timer is set for 15 minutes. Kickoff is the first play of the game and is also done at half time. One projectile 700 is used for kickoff. The projectile 700 must stay on game surface 202. If projectile 700 goes off the side of the board it is an off sides penalty and a loss of 5 yards (5 yards is added to the resultant kickoff yardage). Landing a projectile 700 on the first or last spaces of game surface 202, or throwing a projectile that results in sliding off of game board 200, results in an automatic 25 yard line field position. Punt yardage marker line 207 on the side of game surface 202 indicates how much of a return there is from the end zone after the initial toss or "kick."

For kickoff, the "kicker" tosses projectile 700 on to game board 200. When the bag lands on the board, the yardage is determined by the punt yardage marker line 207 on the side of game surface 202 and that bag indicates represents the yardage returned. This yardage should be marked on field position board 300. First down indicator 304 and ball locator 302 as depicted in FIG. 3A should then be moved in relation to the yardage representing the punt yardage achieved by the tossed projectile for kickoff Projectile 700 should then be moved and set aside.

Player two then takes control of all four projectiles 700 and begins his or her turn. Player two then tosses the first projectile 700 onto game surface 202 and marks the new ball location on field position indicator 300 using sliding ball indicator 302. The first projectile should then be placed beside game board 200 to show use of down. The same process is then repeated for bag two and three. The red projectile or forth down projectile should be used last. Before using the red projectile, the player must announce his or her intention for the bag or 5 yards is automatically lost. To increase strategic play, the opposing side can call the five yard penalty or take what is on the field after the bag has been tossed.

When using the red projectile, the player can state that they are going to punt a field goal or "go for it." In the case of a punt, the player tosses the last projectile and then adds the yardage that is indicated on the punt marked sides of game surface 202, then marks the location on field position board 300. Then, the next player takes over and takes control of the four projectiles. In the case of a field goal, the player must pass the projectile between the two goal posts 208 and have the projectile slide off the board. The projectile must land on the board before going through goal posts 208. If the field goal is made for three points, the player must toss one more bag for the kickoff. If the field goal is missed the player must hand over the four projectiles. The new player starts from the old player's field position. In the case of a "go for it" the player tosses their last bag if they make the needed yards they can continue playing. If they miss the needed yardage they must turn over the four projectiles. The new player starts from the old player's field positions. The outcome then should be marked on field position board 300.

Additional opportunities for scoring include kicking an extra point and a touch back. For kicking an extra point, a player positioned at the line of scrimmage stick 600 takes two steps toward game board 200 and tosses the bean bag through goal posts 208. The projectiles must land on game board 200 and go through the goal posts 208 to get the point. Then the player must take one projectile and toss it from the line of scrimmage for the kick off. For a touch back, when a player loses more yards than there are left on the field and goes into the end zone. The player then gives up 2 points and then must tosses a projectile to kick a kick off to the other teams. There are three penalty locations 206 on the field that have circles around them, if the projectile touches the circle the loss of yardage is what is played on that down. As play continues there are four quarters. At the beginning of the third quarter the player that played second kicks off to the first player. Then the game proceeds as before until the end of the forth quarter and the game ends. If at the end of the forth quarter, the score is tied, the game can go into over time and the players can play one more quarter that is started the same way the game is started.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

The invention claimed is:

1. A gaming system for manual game play by at least one player, the gaming system comprising:

a game board having first end and a second end, each of the first and second ends defining a corresponding half of a substantially smooth playing surface, wherein the first end and the second end are shaped as right trapezoidal prisms;

a hinge arranged at an intersection of the first end and the second end and configured to permit rotation of the first end relative to the second end between an open position and a closed position;

a first rectangular face defined by the first end and a second rectangular face defined by the second end, wherein both the first rectangular face and the second rectangular face each abut the hinge, and wherein the first rectangular face and the second rectangular face are substantially identically sized such that:

when the first end and the second end are arranged in the open position, the first rectangular face and the second rectangular face are flush with one another at the substantially smooth playing surface that is one face of a third right trapezoidal prism defined by the combination of the first end and the second end; and when the first end and the second end are arranged in the closed position, the first rectangular face and the second rectangular face are coplanar such that the game board forms a box defining a closed cavity, the playing surface including a plurality of scoring sections and a plurality of field line indicators to separate the sections from one another;

a game positioning board coupled to a ball indicator and a first down indicator, wherein the game positioning board includes scoring indicia that correspond to the field line indicators of the playing surface;

a line of scrimmage stick;

a set of instructions; and a plurality of projectiles, wherein when the hinge is arranged in the closed position, the cavity of the game positioning board is sized to house the line of scrimmage stick, the timer, and the plurality of projectiles.

2. The gaming system of claim 1 further comprising a timer that can be optionally be configured to be received and housed by the game board.

3. The gaming system of claim 1 wherein the hinge is configured such that, when the hinge is arranged in the closed position, the game board is configured to fold in half such that the first end of the game board is adjacent to the second end of the game board.

4. The gaming system of claim 1 wherein the game board further comprises a closure mechanism and a handle.

5. The gaming system of claim 1 further comprising at least two goal post pieces, and wherein the game board defines at least two openings each of which is dimensioned to receive a corresponding goal post piece, and wherein the closed cavity is further configured to hold the at least two goal post pieces.

6. The gaming system of claim 1 further comprising indicia on the playing surface associating yardage lines and punt hash marks with point values, the point values being associated with a corresponding change in position of the ball indicator and the first down indicator on the game positioning board as described in the set of instructions.

7. The gaming system of claim 1 wherein the game surface further comprises a plurality of penalty areas dimensioned to receive one of the plurality of projectiles, each of the plurality of penalty areas being associated with a corresponding change in position of the ball indicator on the game positioning board as described in the set of instructions.

8. The gaming system of claim 1 further comprising a plurality of line of scrimmage sticks.

* * * * *